US007705263B2

(12) United States Patent
Rane et al.

(10) Patent No.: US 7,705,263 B2
(45) Date of Patent: Apr. 27, 2010

(54) ARC CHUTE ASSEMBLY FOR A CIRCUIT BREAKER

(75) Inventors: Mahesh Jaywant Rane, Secunderabad (IN); Janakiraman Narayanan, Andra Pradesh (IN); Yatin Vilas Newase, Maharashtra (IN); Pankaj Agrawal, Bangalore (IN)

(73) Assignee: General Electric Company, Schenectady, NY (US)

( * ) Notice: Subject to any disclaimer, the term of this patent is extended or adjusted under 35 U.S.C. 154(b) by 115 days.

(21) Appl. No.: 12/103,008

(22) Filed: Apr. 15, 2008

(65) Prior Publication Data

US 2009/0255906 A1 Oct. 15, 2009

(51) Int. Cl.

| | |
|---|---|
| ***H01H 9/30*** | (2006.01) |
| ***H01H 33/00*** | (2006.01) |
| ***H01H 33/02*** | (2006.01) |
| ***H01H 33/04*** | (2006.01) |
| ***H01H 9/44*** | (2006.01) |
| ***H01H 33/18*** | (2006.01) |

(52) U.S. Cl. ..... 218/149; 218/15; 218/34; 218/35; 218/36; 218/37; 218/38; 218/39; 218/40; 218/41; 218/81; 218/155; 218/156; 218/157; 335/201

(58) Field of Classification Search ..... 218/7, 218/14, 15, 34–41, 81, 147–158; 335/16, 335/147, 201–202

See application file for complete search history.

(56) References Cited

U.S. PATENT DOCUMENTS

| | | | | | |
|---|---|---|---|---|---|
| 3,005,892 | A * | 10/1961 | Yarrick | 218/149 |
| 3,202,790 | A * | 8/1965 | Burton | 218/149 |
| 3,374,332 | A * | 3/1968 | Bould | 218/149 |
| 3,621,169 | A * | 11/1971 | Heft et al. | 218/152 |
| 3,728,503 | A * | 4/1973 | Clausing et al. | 218/149 |
| 4,950,852 | A * | 8/1990 | Goldman et al. | 218/150 |
| 4,963,849 | A * | 10/1990 | Kowalczyk et al. | 335/201 |
| 6,248,971 | B1 * | 6/2001 | Morel et al. | 218/157 |
| 6,703,576 | B1 | 3/2004 | Chou et al. | |
| 6,977,354 | B1 * | 12/2005 | Shea et al. | 218/157 |
| 2003/0048586 | A1 * | 3/2003 | Faber et al. | 361/1 |
| 2006/0096954 | A1 * | 5/2006 | Shea et al. | 218/157 |
| 2007/0062912 | A1 | 3/2007 | Rival | |
| 2008/0067153 | A1 * | 3/2008 | Pollitt et al. | 218/154 |

* cited by examiner

*Primary Examiner*—Lincoln Donovan
*Assistant Examiner*—Mohamad A Musleh
(74) *Attorney, Agent, or Firm*—GE Global Patent Operation

(57) ABSTRACT

An arc chute assembly includes a housing having a lateral axis and a quenching portion disposed within the housing. The quenching portion includes at least two deion plates being spaced along the lateral axis of the housing and each having a cut portion wherein the cut portions are staggered along the lateral axis with respect to one another and are configured to mitigate an arc.

10 Claims, 5 Drawing Sheets

ARC CHUTE ASSEMBLY FOR A CIRCUIT BREAKER

BACKGROUND

The present invention relates to electrical switchgear. More particularly, the present invention relates to an arc chute assembly.

Circuit breakers and other electrical switching apparatuses typically include a set of stationary electrical contacts and a set of moveable electrical contacts. The stationary and moveable contacts are in physical contact with one another when it is desired that the circuit breaker provide electrical current to a load. However, when it becomes necessary to interrupt the circuit the moveable contacts are moved away from the stationary contacts, thus removing the moveable contacts from physical contact with the stationary contacts and creating a space there between. This may result in the formation of an electrical arc beginning at the time the contacts are separated.

In these particular instances, electrical arcs (also known as "arc discharges") are undesirable for a number of reasons. First, they provide a pathway for current to flow through the circuit breaker to a load when it is desired that the load be isolated from such current. Additionally, the electrical arc extending between the contacts often results in vaporization or sublimation of the contact material itself, eventually resulting in destruction or pitting of contacts.

As a result, manufactures of breakers and switching gear have developed mechanisms to facilitate quenching of this undesirable arc discharge. For example, early manufactures used a method of immersing the contact material in an oil, or inert gas, while others created a vacuum to quench arcing. More recently, the development of arc chutes has been a preferred method to quench undesirable arcing.

For example, U.S. Pat. No. 6,703,576 provides an arc chute having a main valve formed by a flexible sheet member that is mounted over a gas opening of the arc chamber structure by extensions on arc plates that form guides received in elongated slots in the ends of the flexible sheet member. The force generated by high pressure gas in the arc chamber on the center of the flexible sheet member causes it to bow allowing arc gases to escape laterally as the ends of the flexible sheet member are drawn towards each other.

Another exemplary breaker assembly including an arc chute is described in U.S. Patent Application US20070062912A1, which comprises an arc chute having two side parallel flanges, a rear wall, and a bottom arcing horn made of conducting material, electrically connected to the stationary contact part. The bottom arcing horn is surrounded by a periphery made of gas-generating material. The arc chute comprises a stack of separators at least two of which separators comprise a notch, at least one regenerating separator placed parallel to the bottom arcing horn, the at least one separator comprising at least one metallic surface covering at least half of the notches in the longitudinal mid-plane.

BRIEF DESCRIPTION

In accordance with one embodiment of the present invention an arc chute assembly comprises a housing having a lateral axis and a quenching portion disposed within the housing. The quenching portion comprises at least two deion plates being spaced along the lateral axis of the housing and each having a cut portion wherein the cut portions are staggered along the lateral axis with respect to one another and are configured to mitigate an arc.

Other features and advantages of the disclosure will become apparent by reference to the following description taken in connection with the accompanying drawings.

BRIEF DESCRIPTION OF THE DRAWINGS

Reference is now made briefly to the accompanying drawings, in which.

Like reference characters designate identical or corresponding components and units throughout the several views, which are not to scale unless otherwise indicated.

DETAILED DESCRIPTION

One embodiment of the present invention involves an arc chute assembly which comprises a housing and a quenching portion disposed within the housing. The quenching portion comprises at least two laterally spaced deion plates having a cut portion wherein the cut portions are staggered with respect to one another and are configured to mitigate an arc. Exemplary advantages afforded by this invention is its easy to assemble modular design, improved structural strength to withstand pressure developed during high short circuit fault levels, its improved arc quenching capability and its improved life span for interruption of rated current.

Specific configurations and arrangements of the claimed invention, discussed below with reference to the accompanying drawings, are for illustrative purposes only. Other configurations and arrangements that are within the purview of a skilled artisan can be made, used, or sold without departing from the spirit and scope of the appended claims. For example, while some embodiments of the invention are herein described with reference to a circuit breaker, a skilled artisan will recognize that embodiments of the invention can be implemented in other electrical switching devices in which arc quenching is advantageous.

As used herein, an element or function recited in the singular and proceeded with the word "a" or "an" should be understood as not excluding plural said elements or functions, unless such exclusion is explicitly recited. Furthermore, references to "one embodiment" of the claimed invention should not be interpreted as excluding the existence of additional embodiments that also incorporate the recited features.

Figure 1:
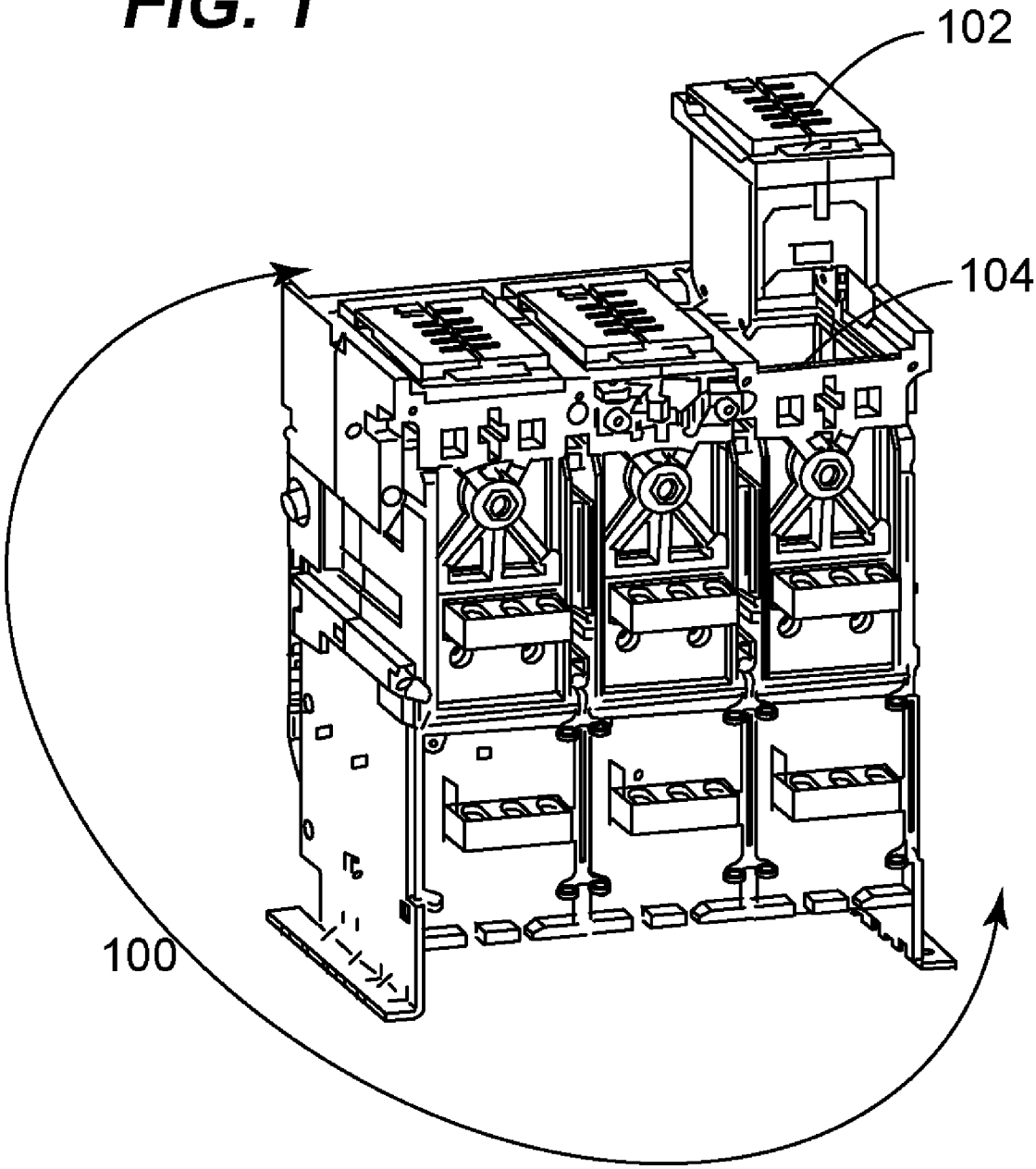
FIG. 1 is a perspective view of a circuit breaker array to which embodiments of the present invention relate.

Referring now to FIG. 1, a circuit breaker array 100 that may be used with an embodiment of the present invention may comprise known circuit breaker components, e.g., contacts, latches, solenoids, and actuators (all of which are not shown or described herein). An arc chute assembly in accordance with one embodiment of the present invention is shown generally at 102. The arc chute assembly 102 may be dimensioned to correspond to the breaker aperture 104 and, when inserted, function to mitigate any electrical arc created as contacts move away from one another in a circuit breaker.

Figure 2:
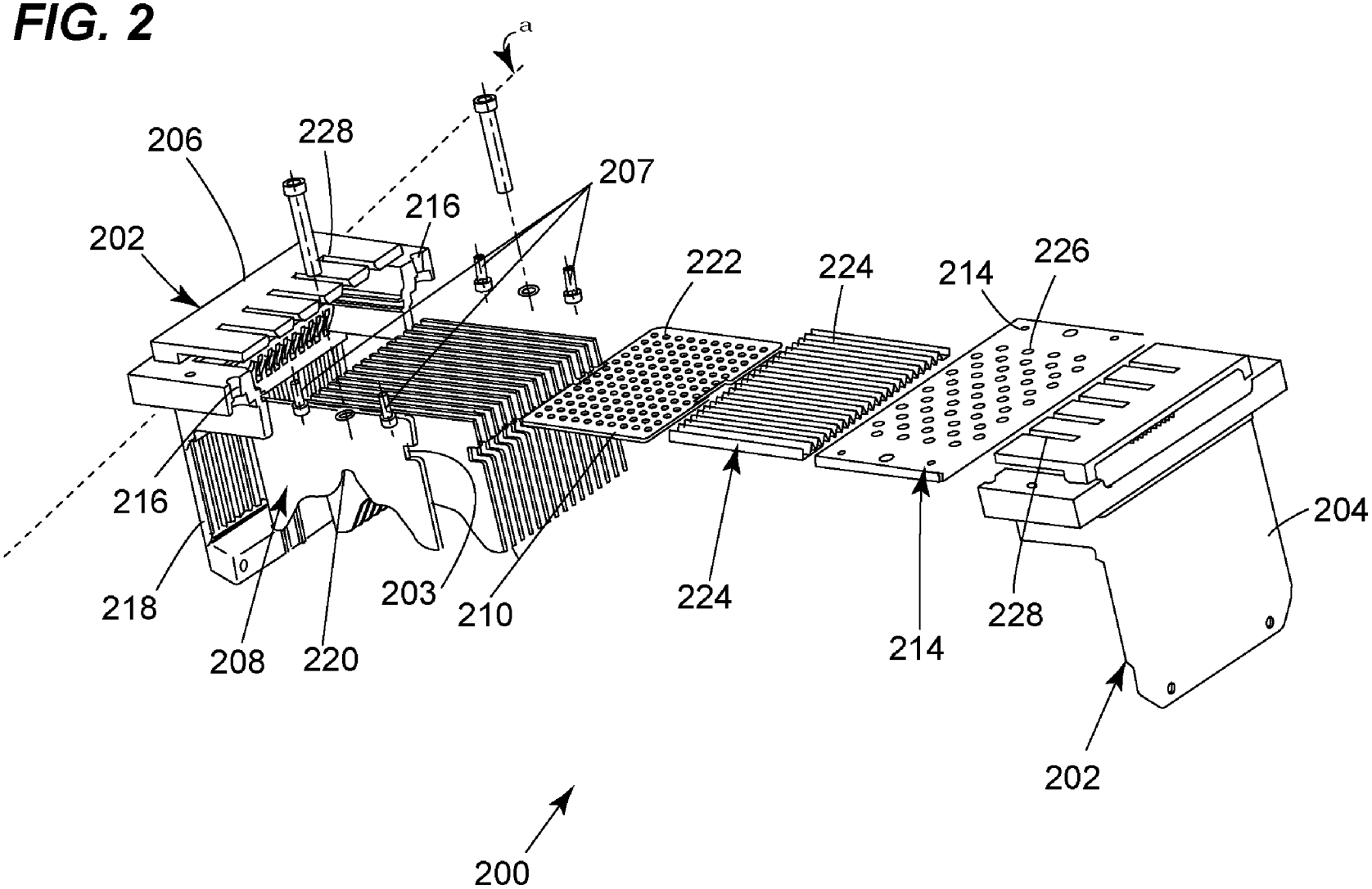
FIG. 2 is an exploded view of an exemplary arc chute assembly to which embodiments of the present invention relate.

Referring now to FIG. 2, an exemplary embodiment of an arc chute is shown generally at 200. The arc chute assembly may comprise a housing 202, deion plates 208, an insulating member 210, a filter 224 and stability member 214.

The housing 202 may comprise an insulative and moldable substance such as a polymeric substance and may comprise a generally bifurcated structure resulting in housing members 204 and 206 that may be connected together by fasteners 207 together with a stability member 214 (as described in more detail below). However, it is to be appreciated that any connecting means (e.g., screws, nails, paste) may be employed for combining each chamber to form a desirable housing. It is to be further appreciated that the housing may be constructed with any material that may suitably withstand the inherent heat given off by a breaker assembly while not substantially interfering with a breakers required magnetic properties.

Each housing member 204 and 206 comprises venting slots 228 which will be described in greater detail below.

In this exemplary embodiment of the present invention, the housing 202 may allow for a modular form that lends itself to drop-down assembly. Therefore, in one particular embodiment, arc chute assembly 200 may be installed into a circuit breaker array 100 (FIG. 1) at any time due to its flexible assembly. In case the arc chute 200 is inserted in a circuit breaker in an undesired orientation, the projection 504 on the arc runner plate 502 (see FIG. 5) will interfere with a corresponding projection on the breaker housing. This will ensure proper alignment of the arc chute 200 and will prevent assembly of arc chute in an improper orientation.

With further reference to FIG. 2, insulating member 210 may comprise an insulating sheet comprising venting apertures 222. The insulating member may be arranged, in turn, to isolate the deion plates 208 from the metallic filter 224 while allowing arc gasses to move outwards through the venting apertures 222. The insulating member may be constructed from an electrically nonconductive material, e.g., glass melamine, glass epoxy sheet, polyester based material and may be oriented orthogonally with respect to the deion plates.

Again with reference to FIG. 2, filter 224 may be disposed within the housing and arranged adjacent to the insulating member 216 and orthogonal to the deion plates 208. The filter 224 may comprise a perforated sheet metal having a wavy structure, such as a generally sideways S-shape in cross section, and be configured to filter arc products such as hot metal particles.

In another embodiment of the present invention, the invention may further comprise stability member 214. The stability member 214 may be disposed adjacent to the metallic filter 224 inside the housing 202. The stability member may comprise, for example, a steel plate and may be oriented orthogonally with respect to the deion plates 208. Although, as shown, the stability member is in the configuration of a plate, it is to be appreciated that stability members may comprise other geometric configurations such rods, pins, and the like may be employed. The stability member 214 may be configured to add structural strength to the assembly to withstand pressure that may be developed under high-fault conditions. The stability member 214 may be further configured to allow for the arc gases to move outwards though the venting apertures 228, and therefore may further comprise stability member apertures 226.

The venting slots 228 may be configured to facilitate the movement of arc gases that may develop during circuit breaker function (i.e., when arcs form). For example, the venting slots 228 may comprise a plurality of elongated spaces in the top wall of the housing, thereby facilitating arc gases movement up through the deion plates 208, through the insulating member 210 and the stability member 214 and outwardly from the breaker assembly.

Again with reference to FIG. 2, the deion plates 208 may be disposed within the housing 202 and dimensioned to fit into support members 218, which will be discussed in greater detail with reference to FIGS. 3 and 4. As shown in FIG. 2, a plurality of deion plates 208 may be laterally spaced through the housing 202. Each deion plate 208 may comprise a mounting slot 203 that is correspondingly configured to engage a projection 303 (FIG. 3) of the housing. The mounting slot 203 and projection 303 (FIG. 3) may be generally rectangular in cross section. This being away from the working portion or arcing region, in case of the low current arc formation, and affixes the deion plates 208 to the housing 202 and in position without deterioration due to arcing. This improves the electrical switching life of the arc chute at rated currents.

Each deion plate 208 may further comprise a cut portion 220. The cut portion 220 may be generally arcuate in shape having a notch and may be configured to allow contacts to move therethrough. While the deion plates may be substantially parallel with respect to one another, the cut portion of each deion plate may be staggered with respect to one another, which will be discussed in greater detail below with respect to FIG. 3. By "staggered" it is meant that the cut portions are arranged on or as if on alternating sides of a centerline proceeding down an axis (a) of housing member 206.

This arrangement of the deion plates 208 and the cut portions 220 with respect thereto provides for optimal quenching of an electrical arc by giving effective magnetic pull to the arc column. This arrangement also has been found to quench arcs across various fault levels and system voltages. Furthermore, the deion plates 208 may be composed of ferromagnetic material such as steel alloys.

Figure 3:
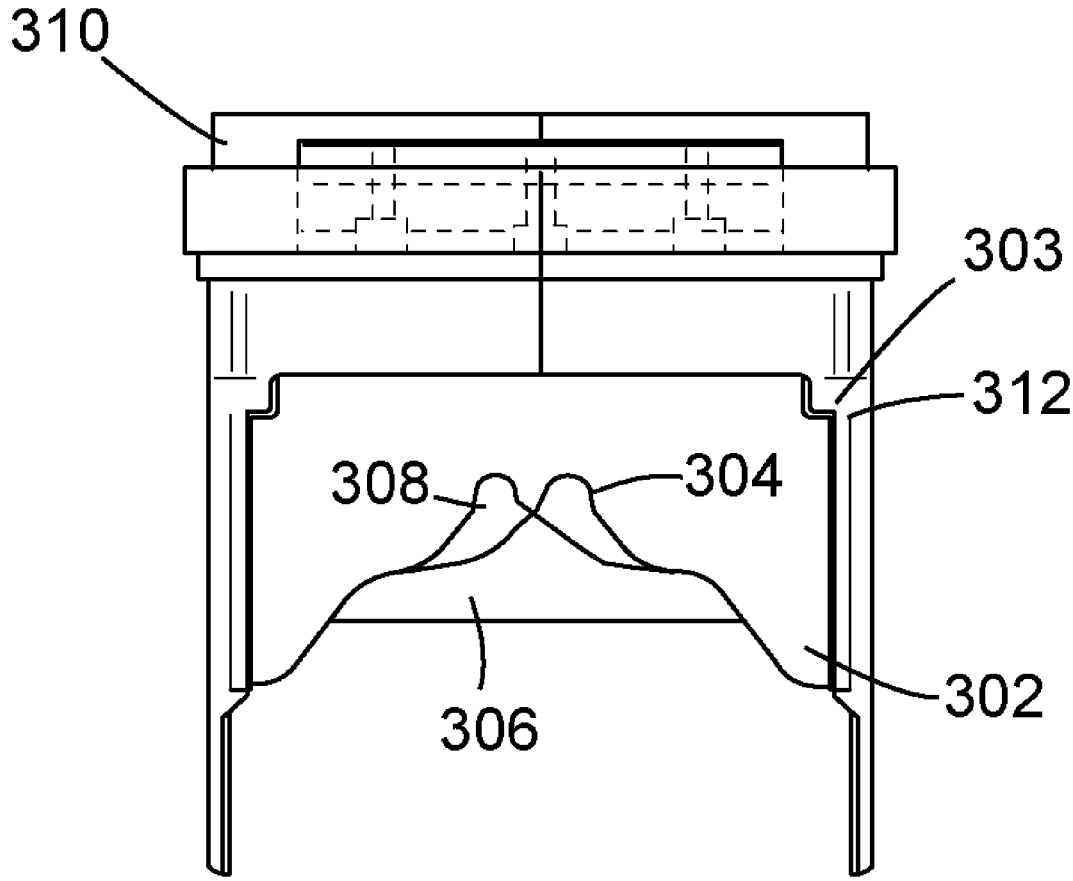
FIG. 3 is an end view of the arc cute assembly of FIG. 2 showing deion plates within a housing.

Referring now to FIG. 3, there is shown another view which best illustrates a staggered arrangement of cut portions of a number of deion plates in accordance with an exemplary embodiment of the present invention. In this exemplary embodiment there is shown two deion plates 302 and 306. The first deion plate 302 comprises cut portion 304 and the second deion plate 306 comprises cut portion 308. The deion plates are configured laterally with respect to one another, and are attached to the housing 310 via support members 312. The cut portion 304 of the first deion plate 302 is staggered with respect to the cut portion 308 of the second deion plate 306. It is to be appreciated that this alignment may continue as more deion plates are added to the assembly.

Figure 4:
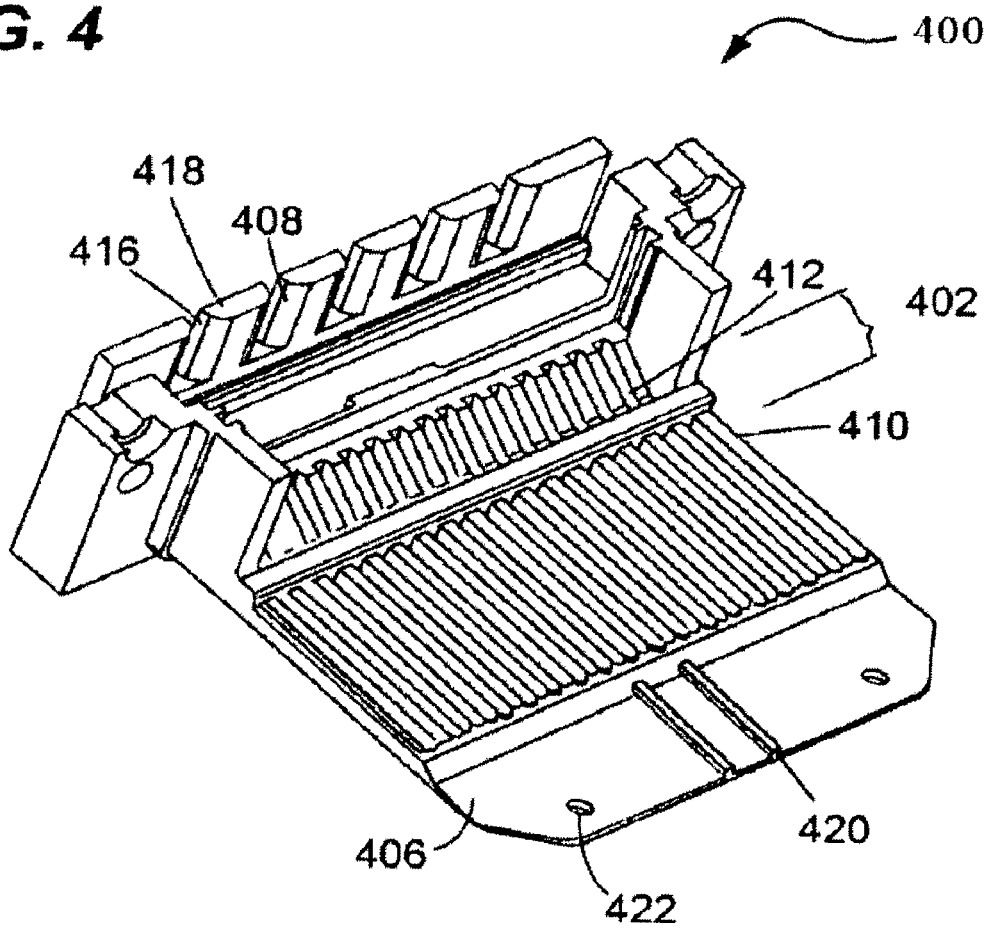
FIG. 4 is a perspective view of a housing member of the arch chute assembly of FIG. 2.

Referring now to FIG. 4, there is shown one housing member 400 of an arc chute assembly. Housing member 400 comprises a support member 402, extended flange 406 and venting slots 408.

The support member 402 may comprise angular array of support members 410 and a parallel support members 412. The support members 410 and 412 may be dimensioned to retain a plurality of deion plates in a lateral arrangement. The angular array of support members 410 may be dimensioned to correspond to a corner of a deion plate, while the parallel support members 410 may be dimensioned to correspond with a bottom portion of a deion plate.

The venting slots 408 may be formed by tabs 418. Because only a portion of the chute assembly is shown, it is to be appreciated that analogous tabs on a second portion of another housing member of the assembly (not shown) may combine to form the venting apertures. The tabs 418, as shown, have an angled profile 416 to act as a nozzle thereby more readily facilitating the escape of arc gases.

The flange 406 may be an extended section of a side of the housing. The flange 406 may be configured to protect the circuit breaker housing from corrosion, pitting and breakdown during arcing. The extended flange 406 may comprise rib pieces 420 which maybe configured to increase over surface dielectric capacity due to increased over surface distance. The flange may also comprise mounting bores 422 for mounting ablative liners, which helps to quench the arc efficiently.

Figure 5:
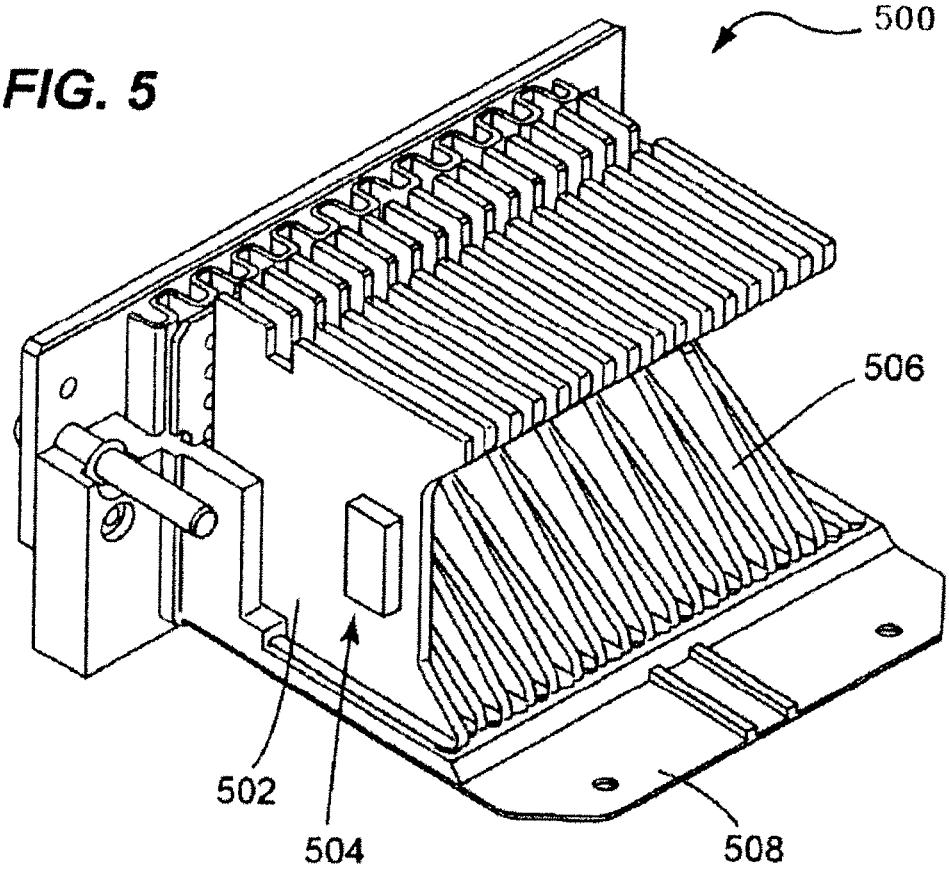
FIG. 5 is a perspective view of the arc chute assembly of FIG. 2 omitting a housing member.

Referring now to FIG. 5, a view best illustrating the arc runner 502 employed at one end of an array of deion plates 506 having a protrusion 504 is shown at 500. For purposes of orientation, deion plates 506 and flange 508 are also shown. The arc runner 502 may be configured to guide the electrical arc between movable contact and the deion plates. The protrusion 504 is configured to prevent reverse assembly in the circuit breaker.

Although specific features of various embodiments of the invention may be shown in some drawings and not in others, this is for convenience only. In accordance with the principles of the invention, the feature(s) of one drawing may be combined with any or all of the features in any of the other drawings. The words "including", "comprising", "having", and "with" as used herein are to be interpreted broadly and comprehensively and are not limited to any physical interconnection. Moreover, any embodiments disclosed herein are not to be interpreted as the only possible embodiments. Rather, modifications and other embodiments are intended to be included within the scope of the appended claims.

What is claimed is:

1. An arc chute assembly comprising: a housing having a lateral axis, the housing comprising: a first housing member; a second housing member removably connected to the first housing member, wherein the first and second housing members each comprise a stability member and (a) a first housing wall comprising a first longitudinal axis, the first housing wall further comprising a flange piece configured to shield the housing and disposed along the first longitudinal axis;

(b) a second housing wall comprising a second longitudinal axis, the second housing wall being attached substantially orthogonally to the first housing wall and comprising at least one tab having an angled profile and disposed along the second longitudinal axis; an arc runner plate supported by the housing, the arc runner plate comprising a protrusion configured to disallow reverse assembly of the arc chute assembly; and a quenching portion disposed within the housing, the quenching portion comprising: at least two deion plates disposed along the lateral axis of the housing, each of the at least two deion plates having a cut portion wherein the cut portions are staggered along the lateral axis with respect to one another and are configured to mitigate an arc.

2. The apparatus of claim 1, further comprising an insulating member disposed within the housing and functioning to electrically isolate the deion plates wherein the insulating member comprises venting apertures.

3. The apparatus of claim 2 further comprising filter member having a wavy configuration disposed adjacent to the insulating member.

4. The apparatus of claim 3, wherein the filter member comprises sheet metal.

5. The apparatus of claim 1, wherein the stability plate comprises steel.

6. The apparatus of claim 1, further comprising a projection located on the arc runner plate configured to facilitate alignment during assembly.

7. The apparatus of claim 1, wherein the at least one deion plate comprises a plurality of deion plates and further comprises an angular array of support members configured to retain the deion plates.

8. The apparatus of claim 1, wherein the flange piece further comprises a mounting bore for an ablative lining.

9. The apparatus of the claim 1, wherein the flange piece further comprises at least one rib configured to increase surface dielectric capacity.

10. The apparatus of claim 1, wherein the at least two deion plates each comprise a mounting slot; and wherein the housing has a protrusion configured to mate with the mounting slots and thereby support the deion plates.

* * * * *